United States Patent [19]

Thomas

[11] 4,017,350

[45] Apr. 12, 1977

[54] LABELLING MACHINE

[75] Inventor: James Ernest Thomas, Dagenham, England

[73] Assignee: Pricemaster Ltd., Degenham, England

[22] Filed: Mar. 5, 1975

[21] Appl. No.: 555,905

[52] U.S. Cl. ..... 156/384; 156/363; 156/541; 156/542; 156/584

[51] Int. Cl.[2] ..... B65C 9/18; B65C 9/42

[58] Field of Search ..... 156/230, 238, 277, 350, 156/354, 355, 363, 540, 541, 542, 577, 584, DIG. 2, DIG. 25, DIG. 33, DIG. 45, DIG. 48, DIG. 49

[56] References Cited

UNITED STATES PATENTS

| | | | |
|---|---|---|---|
| 2,939,599 | 6/1960 | Schluter | 156/541 |
| 3,238,080 | 3/1966 | Schluter | 156/363 |
| 3,436,294 | 4/1969 | Marano | 156/384 |
| 3,793,114 | 2/1974 | Thomas | 156/542 |

FOREIGN PATENTS OR APPLICATIONS

| | | | |
|---|---|---|---|
| 1,086,261 | 10/1967 | United Kingdom | 156/DIG. 45 |

*Primary Examiner*—Caleb Weston

*Attorney, Agent, or Firm*—Allison C. Collard

[57] ABSTRACT

A labelling machine, employing strip which bears pressure-sensitive adhesive labels, is operated by articles conveyed in succession past the machine. Each article moves an arm, thereby advancing the strip by an amount less than the pitch length of the labels to present a partially detached label at applicator rollers, where it adheres to and is detached by the passing article. In this way labelling can be effected at higher rates than previously. In detaching the label, the article also pulls the strip into position for when the next article moves the arm. Guides, relatively movable in one sense by the arm, or by another arm moved by the article, and in the opposite sense by gravity, and consisting of three rollers, or of a rotary cam and a roller, vary the path length of the strip cyclically in the machine by the above amount, thereby advancing the strip and presenting the partially detached label at the applicator. The machine, instead of being operated by the moving articles, can be operated by flights on the conveyor for the articles. The flights contact the arm or arms or work a linkage to the machine.

14 Claims, 9 Drawing Figures

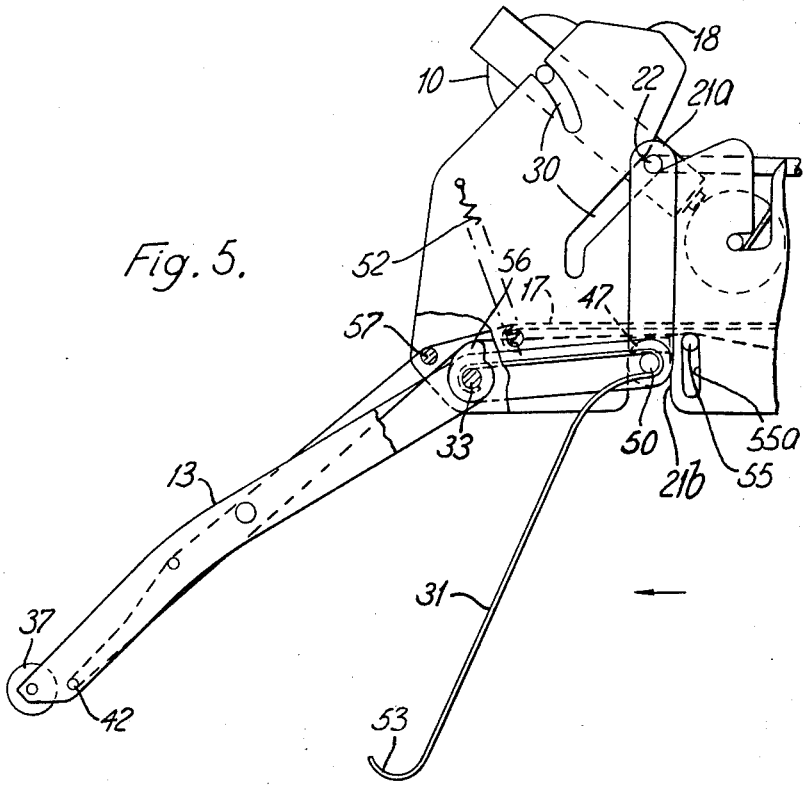
Fig. 5.
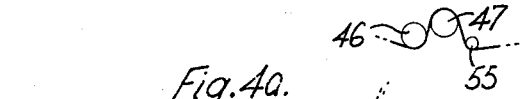
Fig. 4a.
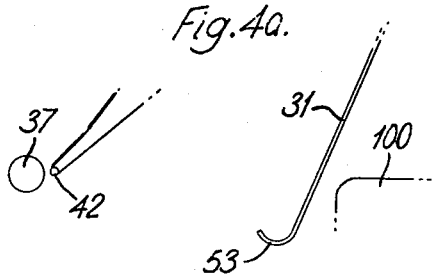
Fig. 4b.
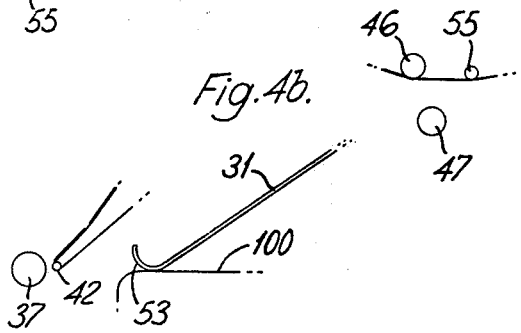
Fig. 4c.
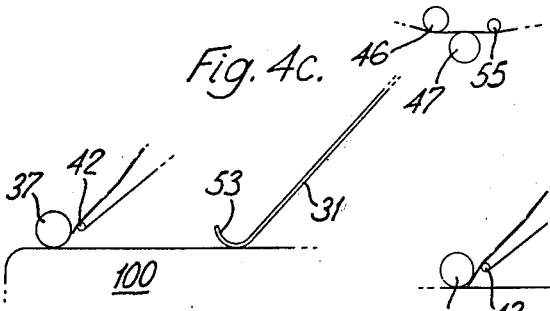
Fig. 4d.
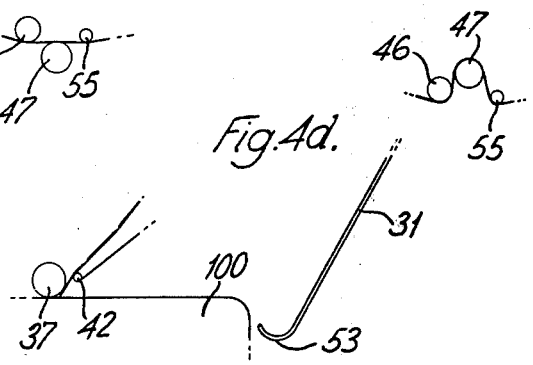

LABELLING MACHINE

This invention relates to a labelling machine suitable for use with a conveyor for moving a succession of articles to be labelled. The machine operates on a repetitive cycle and employs a known kind of strip which bears adhesive labels spaced apart at a constant pitch therealong. When such a strip is led round a guide in the machine, the labels peel off singly in each cycle so that they can be applied by the machine to the articles as they move past. Such a machine is referred to in this Specification as a labelling machine of the kind hereinbefore referred to.

Such of our earlier machines which are suitable for use with a conveyor each employ a pawl, the nose of which is directed upstream of the strip which is drawn intermittently from a supply reel to an applicator arm at which the labels peel off in succession. The pawl is operated to engage the leading edge of each label on its way to the applicator to ensure intermittent arrest of the strip and ensure correct positioning of each label under a printing head in the machine; and to ensure that only one label peels off on each advance of the strip past the applicator.

These earlier machines are satisfactory in labelling articles up to a rate of about 50 per minute but if higher rates are attempted there is a likelihood that the pawl will strip off the labels, and the applicator arm itself will become bent by impact of the articles being conveyed.

An object of the present invention is to enable labelling to be carried out satisfactorily even at the higher rates, possibly up to a rate of 150 per minute.

This present invention resides in a labelling machine comprising a label applicator and means for advancing the strip past the applicator by an amount less than the pitch length of the labels in each cycle of operation of the machine. By pitch length in this specification is meant the distance between the leading edges of successive labels on the strip. Thus a leading portion of each label is detached by the labelling machine from the strip by an amount less than the length of the label whereas the remainder of the label is detached by adhesion of the leading portion of the label to an article and by advance of the article past the machine.

In each cycle of operation of our earlier machines the strip was advanced intermittently by an amount equal to the pitch length of the labels on the strip. Each label was virtually wholly peeled off by the applicator, detachment of the adhesive face of the label from the strip being complete but the label would often hang freely and tenuously by its rear edge from the strip if the label had not become deposited on a passing article.

In one preferred construction embodying the present invention the machine comprises an assembly of relatively movable guides for causing the path of the strip between the applicator and a winding-up reel for spent strip to be cyclically lengthened and shortened, thereby to draw strip past the applicator to initiate dispensing of a label in each cycle of operation of the strip advancing means. Relative movement of the guides in the assembly is preferably caused by a member arranged to be contacted and moved by the article. The instant at which partial detachment of a label from the strip occurs is therefore dependent on there being an article present to operate the machine. This arrangement enables both random operation of the machine and the dispensing of more than one label on the article to be avoided.

In that preferred construction, the applicator as well as the strip advancing means have respective cycles of movement, but it is the operation of the strip advancing means which determines when and with what acceleration a label shall be dispensed.

The acceleration imposed on the label being dispensed is directly related to the feed rate of the article being conveyed past the machine if the member is arranged to be contacted and moved by the article to cause lengthening of the strip path. We have found that when this feed rate is above a critical rate the label is dispensed too quickly for the applicator to apply the label to the article, and the article does not become labelled at all. We remedy such a fault by causing the label to be dispensed with a lower acceleration than is possible when the member is moved by the article to cause lengthening of the strip path and when the feed rate of the article is at or above the critical rate. Our remedy consists in arranging for the lengthening of the strip path to be caused by movement of the member under gravity, and the shortening of the strip path to be caused by contact and movement of the member by the article.

In another construction which embodies the invention, there are provided a first guide at a fixed location in the machine (the location can be on the applicator is fixed), a movable second guide, and means for moving the second guide to cause the path of the strip between the first guide and the winding-up reel for spent strip to be cyclically lengthened and shortened, thereby to draw strip past the applicator to initiate dispensing of a label in each cycle of operation of the strip advancing means. This construction, which is adapted to print the labels, can be compact if the means for moving the second guide are drivingly connected to the winding-up reel and to a printing head, which is guided for movement in the machine.

Examples of labelling machine embodying the present invention will now be described with reference to the accompanying drawings, in which:

FIGS. 4A to 4D are sequence of operation diagrams; and

FIG. 5 is a fragmentary view of a modification of FIG. 3.

Figure 1A:
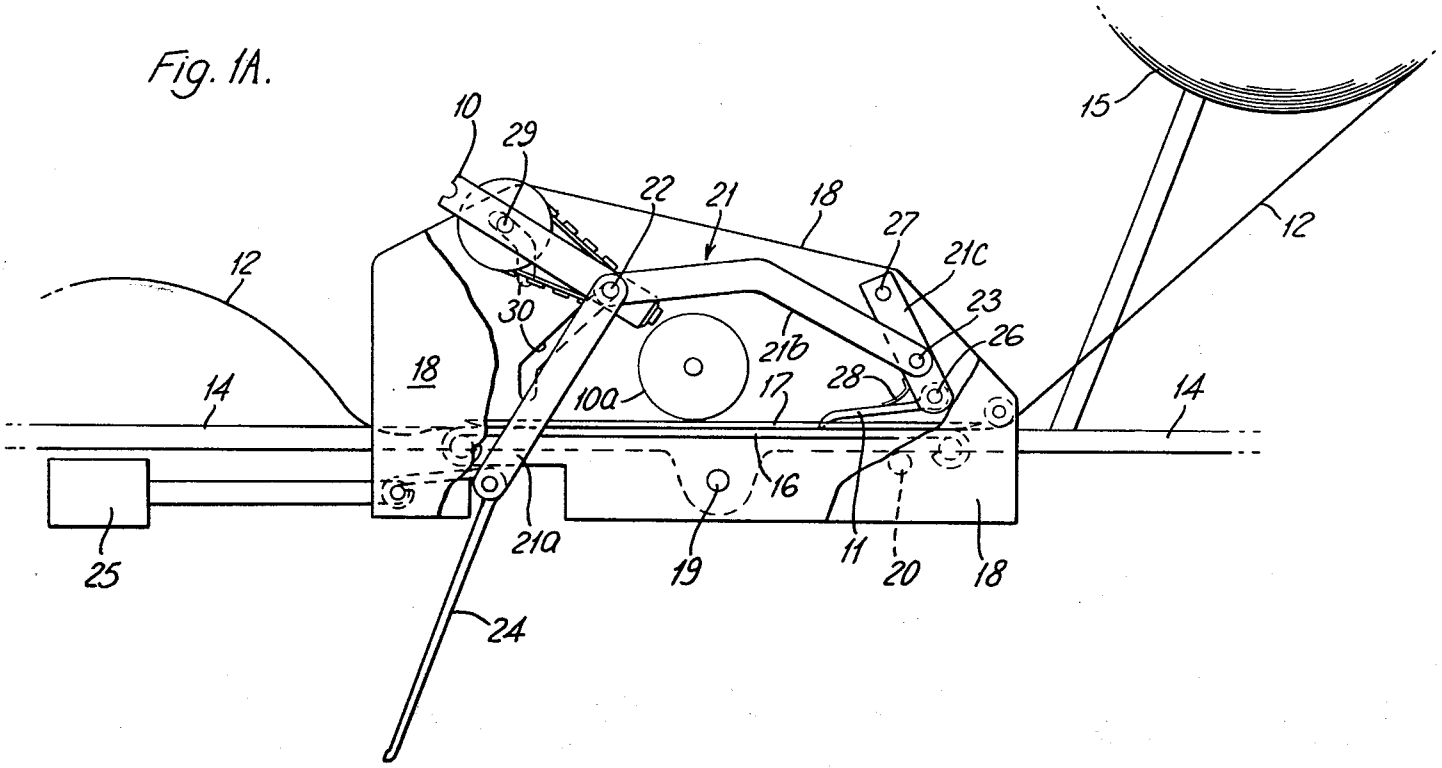
FIGS. 1A and 1B show a first form of machine as a part-sectional side elevation, which is in two parts for convenience of scale.
Figure 1B:
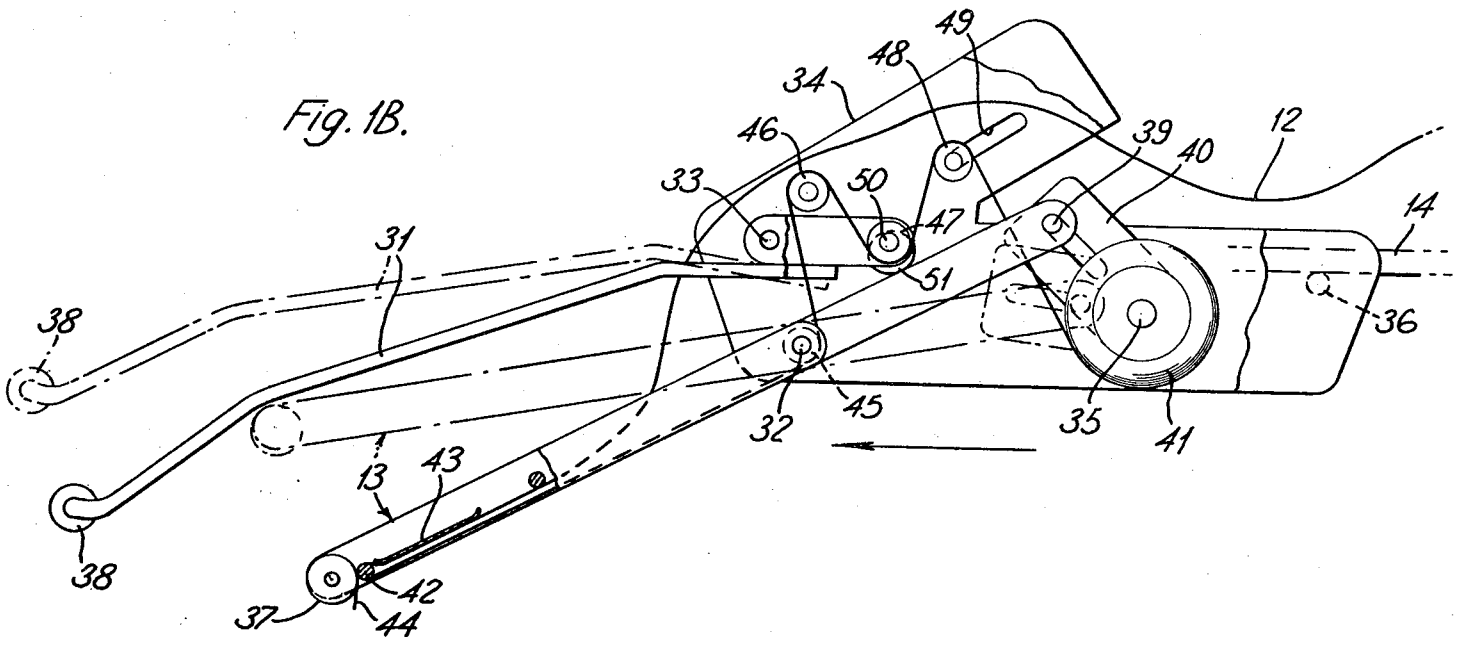

Referring to FIGS. 1A and 1B, the machine is for use with a conveyor (not shown) which advances intermittently or continuously in the direction of the arrow past the machine.

For convenience the machine includes a printing head 10 and this together with a pawl 11 for advancing label-bearing strip 12 past the printing head, is mounted separately from a label applicator 13 on a fixed cantilever mounting 14, and independently operated of the applicator by successive articles on the conveyor.

Above the cantilever 14 is a supply reel 15 of the strip. The reel 15 is freely rotatable and the strip 12 is guided past the pawl 11 and printing head 10 between a backing plate 16 and a pair of metal strips 17. The metal strips 17 are parallel and mutually spaced to engage only the margins of the label strip 12 and allow the labels, which face upwards, to be exposed to the pawl 11.

The pawl 11 and printing head 10 are carried between a pair of side plates 18 of a structure supported by a pivot 19 on the cantilever and by a stop 20. Movements of the pawl 11 and head 10 are coordinated by a linkage 21, comprising pairs of linds 21*a*, 21*b*, 21*c* connected by pivots 22, 23, and deriving movement from a cranked arm 24 biased by a counterweight 25 to the position shown.

The pawl 11 itself is on a pivot 26 at the lower ends of the pair of links 21*c* which is suspended from a pivot 27 at their upper ends. The nose of the pawl 11 is forwardly directed at a shallow angle to the strip and lightly loaded by a spring 28 to contact the rear edges of successive labels. The links 21*c* can be swung forward from the position shown, and back.

The printing head 10, which is also suspended from a pivot 29 and can be swung forward from the position shown and back past an inking roller 10*a*, is furthermore guided by upper and lower slots 30 in the side plates in which the ends of the pivot 29 and of the pivot 22 between the links 21*a*, 21*b*, respectively engage.

The slots 30 not only direct movement of the printing head 10 but also determine the amplitude of movement of the pivot 26 carrying the pawl 11, such movement corresponding to the pitch length of the labels, i.e. the distance between the leading edges of successive labels on the strip 12.

The applicator 13 comprises an arm which is one of a pair, the other being a drawing off or operating arm 31, the pair being carried for independent rocking on respective pivots 32, 33 on a side plate 34 supported by a pivot 35 on the cantilever 14 and by a stop 36. Each arm 13, 31 comprises a pair of laterally spaced metal strips, which carry coaxial rollers 37, 38 respectively between their outer or forward ends. The rollers 37 on the applicator arm 13 apply the labels whereas the rollers 38 on the drawing off arm 31 smoothe the labels down. Both arms 13, 31 are shown in their normal lower positions for contact and operation by articles passing on the conveyor.

The inner end of the applicator arm 13 carries a pin 39 engaging a slotted driving lug 40 of a unidirectional clutch which controls rotation of an on-winding reel drum 41 for spent strip. The driving sense of the lug 40 is counter-clockwise. Driving inside the clutch is transmitted in part by a friction plate. The load on the lug 40 at which clutch slip in the drive sense can occur has a setting such that spent strip can be wound up on the drum 41 but label-bearing strip which is stiff in relation to spent strip will not be drawn past a guide pin 42 of about 3 mm. diameter adjacent to the applicator rollers 37 by the arm 13.

The distance between centres of the pin 42 and applicator rollers 37 is less than the label length.

A guide plate 43 is arranged rearward of the pin 42 and close to it to ensure that label-bearing strip 12, which, as later explained, arrives in a slack state, is guided over the pin 42 and labels begin to peel off at the desired location, one partly peeled label being indicated at 44.

A free roller 45 coaxial with the pivot 32 of the applicator arm is one of an assembly of four free rollers 45 to 48, rollers 46, 48 being at stationary locations on the side plate 34, the location of roller 48 however being adjustable by means of a slot 49 in the side plate 34; and roller 47 being carried at the rear of the drawing off arm 31 remote from its pivot 33. The rollers 46 to 48, the centers of which are disposed as points of a triangle, constitute an assembly of relatively movable guides for the strip 12 whereby the path of the strip is cylindrically lengthened and shortened as later described.

The strip 12 is threaded through the machine from the supply reel 15 and guided under the pawl 11, inking roller 10*a* and printing head 10 by the backing plate 16 and associated metal strips 17. The label strip 12 emerges at the forward ends of the backing plate 16 and the metal strips 17, and is led under the guide plate 43 on the applicator arm 13 and changes direction 180° over the guide pin 42, the strip 12 thereafter being guided under roller 45, over rollers 46, 48 but under the intermediate roller 47 whence the strip is led down in front of the drum 41 upon which it is then wound up.

Rocking of the drawing off arm 31 about its pivot 33 is limited by abutments, conveniently an extension of a pin 50 which engages in a circular hole 51 in the side plate 34. Lateral movement of the roller 47 is correspondingly limited and is such that a full upward swing of the arm 31 corresponds to a lengthening of the strip path between the rollers 46 to 48 by an amount less than the pitch length of the labels, say 25% less.

An article advanced by the conveyor will first strike and swing the cranked arm 24 clockwise thereby causing the linkage 21 to swing the pivot 26 and advance the nose of the pawl 11 (and thus a label it engages) by a pitch length. The same motion of the linkage 21 moves the pivot 22 down to the bottom of the lower slot 30 and thereby causes the printing hed to ink itself and print, the lowermost vertical portions of the slots 30 ensuring that printing takes place when the label is stationary. Once the pivots 22, 29 have reached the bottom of their respective slots 30, further advance of the article causes the arm 24 to rock the side plates 18 about the pivot 19 until the article clears the arm 24. The side plates 18 then descend and are arrested by contact of the stop 20 with the cantilever 14.

The article thereafter contacts and swings the applicator arm 13 clockwise. Slack exists in the strip 12 at any stage of operation of the machine between the forward end of the backing plate 16 and the guide plate 43. The swinging of the arm 13 causes the pin 39 the swing the lug 40 counter-clockwise in the winding-up sense of the drum 41, thereby taking up slack in spent strip from earlier operation of the machine between the guide pin 42 and the drum 41 via the assembly of rollers 45 to 48. The counter-clockwise swing of the lug 40 is arranged to be always substantially greater than required to take up slack strip from the assembly of rollers, the setting of clutch drive already mentioned ensuring that strip still bearing labels is not drawn over the pin 42 by the action of the arm 15 on the lug 40.

The spacing of applicator arm and drawing off arm rollers 37, 38 (for which adjustment may be provided if desired by adjusting the radius of the rollers 38 from the pivot 33) is such that the article in being advanced further will contact the rollers 38 and swing the arm 31 clockwise to the limit allowed by the abutments 50, 51 while the rollers 37 on the applicator arm still engage the article, and moreover, at the location on the article at which a label is required.

Clockwise swing of the drawing off arm 31 causes downward motion of the roller 47 which there-by presses down on the strip between the rollers 46, 48 and momentarily lengthens the strip path, the motion of the roller 47 being limited by engagement of the abutments 50, 51. As the drum 41 is stationary during the downward motion of the roller 47, the drum holds the strip from unwinding from it, the lengthening of the strip path by the motion of the roller 47 causes initial advance of the labelbearing strip, the strip being drawn over the guide pin 42 to the extent that the leading portion of a label peels off. Thus the length of the leading portion of the label is related to the limited downward motion of the roller 47. This leading portion of the label is substantially presented below the applicator rollers 37 where it will adhere to the article. Further advance of the article to which the leading portion of the label is adhering, causes the residual portion of the label to be snatched off the strip by the moving article, the residual portion of the label being that which is adhering to the strip and which is complementary to said leading portion. Because the spent strip is being held by the drum 41, and which is still stationary, the adhesion of the leading portion of the label to the moving article and of the residual portion of the label to the strip, causes the strip to be advanced further by being pulled past the applicator to the extent of the residual portion of the label, the label then becoming fully detached from the strip and applied to the article. Continued advance of the article causes the applied label to be smoothed down by the rollers 38 and causes the arm 31 to pivot the side plates 34 about the pivot 35. Once the article has cleared the rollers 38, the arms 13, 31 and side plate resume their original positions, the stop 36 then contacting the cantilever 14.

Counter-clockwise return of the drawing off arm 31 causes the roller 47 to move upward and shorten the strip path between the rollers 46, 48. The slack thus caused in the spent strip between the applicator guide pin 42 and the wind up drum 41 at the rollers 46, 48 is taken up when the next article operates the arm 13 without drawing a label on the label-bearing strip past the applicator, clutch slip occurring in the drive to the drum 44 when the label-bearing strip is at the guide pin 42.

Figure 2:
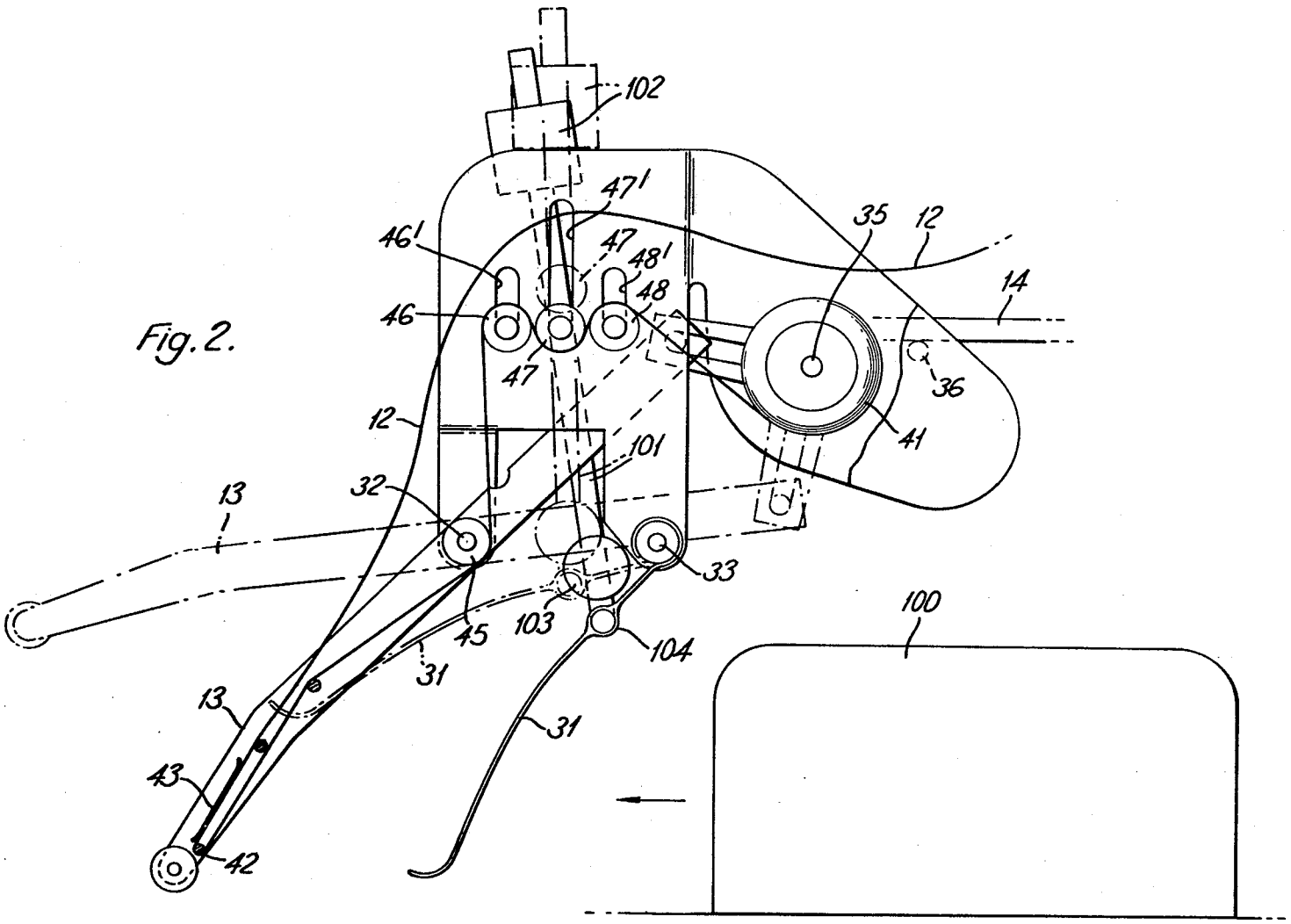
FIG. 2 shows a similar view of the label dispensing portion of a second form of the machine.

Referring now to FIG. 2, the label dispensing portion shown will be assumed to be used in conjunction with construction shown in FIG. 1A, and supported on the same cantilever 14. Where possible, the references used in FIG. 2 correspond with those used in the description of the first form of the labelling machine. A member or operating arm 31 is shown on a pivot 33 arranged to the right of a pivot 32 of a label applicator arm 13, so that the arm 31 is the first of the two arms to be contacted and moved by an article 100 moving in the direction of the arrow.

The applicator arm 13 is linked with a wind-up drum 41 for spent label strip, the strip bearing labels being referenced 12 and supplied by a supply reel (not shown) which corresponds to reel 15 in FIG. 1A.

The strip 12 is advanced intermittently by amounts equal to the label pitch length by the mechanism described with reference to FIG. 1A and is led in a slack state under a guide plate 43 and over a guide 42 adjacent to coaxial rollers 7 which are carried on the outer end of the applicator arm 13.

From the guide 42, the spent strip is led under a free roller 45 to an assembly of free rollers 46 to 48. The rollers 46 and 48 are at stationary locations on a side plate 34 of the machine but their respective locations are adjustable in slots 46′, 48′ which extend parallel. Guided between the slots 46′, 48′ is the roller 47 working in a further slot 47′, the vertical location of the roller 47 being controlled by a substantially vertical link 101, which carries upper and lower weights 102, 103. The lower end of the link 101 connects with an eyelet 104 in the arm 31 adjacent to the pivot 33.

It should be noted that the strip is led over the rollers 46, 48 but under the roller 47.

Thus when the article 100 contacts and swings the arm 31 to the position indicated in broken line, the link 101, weights 102, 103 and the roller 47 are raised, their upper position also being indicated in broken line. The arm 31 is so shaped that, before the article 100 contacts and begins to swing the applicator arm 13 to the upper position indicated in broken line, the roller 47 is clear of the strip extending between the rollers 46, 38. The swing of the arm 13 to the upper position is more than sufficient to cause the winding up drum 41 to take up slack in the strip between the guide 42 on the arm 13, and the drum 41, a friction clutch in the drum 41 being adjusted to slip as soon as the slack has been taken up fully. whilst the applicator arm is in its upper position, supported by the article 100, the other arm 31 slips off the top of the article and down behind it, where it hands in the initial position shown in full line. The free end of the arm 31 is curved in the manner shown in the drawing to make gradual the descent of the arms 31, link 101, weights 102, 103 and roller 47 under gravity. The roller 47 in its descent contacts the strip between the rollers 46, 48 and lengthens the strip path, the final position of the roller 47 corresponding to the initial position shown in full line. This lengthening of the strip path causes the label bearing portion of the strip to be drawn round the guide 42 with partial dispensing of a label. The free end of the label adheres to the article, and is pulled off thereby. The whole label is smoothed down by the applicator rollers 38.

The mechanism shown in FIG. 2 enables labelling to take place even above the critical feed rate of articles which is manifest in the machine shown in FIGS. 1A and 1B.

Figure 3:
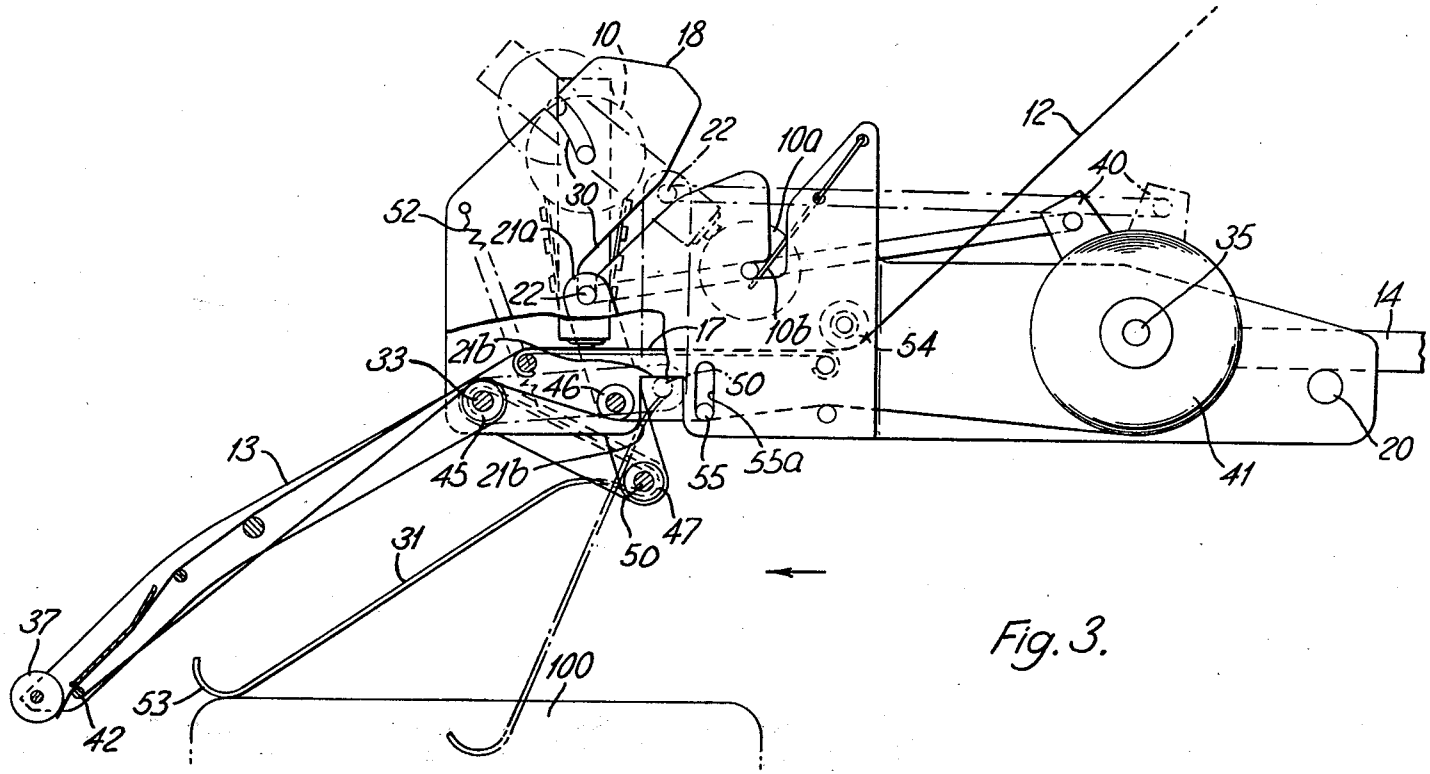
FIG. 3 shows a similar view of a unit which includes a label dispensing portion, printing head and winding-up reel of a third form of the machine.

In FIG. 3, the mechanism shown combines a printing head 10, applicator arm 13 and a winding-up reel 41 in one unit, these reference numerals and those in the following summary description corresponding to those applied to analogous parts in the first two embodiments.

The unit is mounted on a cantilever 14 for pivoting about an axis coinciding with a spindle 35 which supports the reel 41. The unit is normally held by engagement of an abutment 20 against the cantilever 14. Above the cantilever is a supply reel 15 of strip 12.

The printing head 10 is guided for movement by upper and lower slots 30 formed in a pair of side plates 18. The head 10 derives movement from a drive external of the plates 18 on each side comprising an arm 31 and an intermediate link **21*a*. The arms 31 are arranged to be swung forward by an article 100 being conveyed past the unit in the direction of the arrow. The arms 31** are shown swung away from their normal positions shown in chain line.

Each arm 31 is mounted on common pivot and coordinating spindles 33, 50 respectively, and is biased to the chain line position shown by a respective spring 52, the spindle 50 entering the recesses **21*b* and becoming arrested by the edges of the plates 18. The lower end of each arm 31 is curved at 53 to control descent from the top of the article 100.**

The spindle 50 carries a roller 47 on the spindle portion between the side plates 18. The roller 47 is thus swingable in an arc centred on the spindle 33. On the portion of the spindle 33 between the plates 18 is another roller 45. Between the rollers 45, 47 is a roller 46 on a fixed axis. The rollers 45 to 47 are freely rotatable.

A spindle 22 joining the upper parts of the links 21*a* to the head 10 is cranked externally of the back plate 18 in the Figure to drive lug 40 of the winding-up reel 41.

The applicator arm 13 has counterparts of the arm 13 in FIG. 1B but is fixed.

Strip 12 from the reel 15 in the FIG. 3 embodiment is threaded through the unit under a roller 54 which has substantial radial freedom on a fixed axis to enable the roller 54 to bear on the incoming strip and control it on a plate 17 extending between the side plates 18. The strip passes freely below an inking roller 10*a* the spindle of which is lightly biassed forwardly by hair springs 10*b*, and also below the head 10 when in the vertical position shown. Thence the strip passes above the roller 45 (but not in contact with it as will appear later) and on to guide 42 and adjacent coaxial rollers 37 on the applicator arm 13. At the guide 42, the strip turns through 180° and passes over an in contact with the roller 45, under the roller 46, over the movable roller 47 and under a cross pin 55 secure in an adjustment slot 55*a* on the unit, and on to the wind-up reel 41.

Assuming that the parts of the unit are initially in the chain line position, the article 100 is passing the unit first contacts and swings the arms 31 forward against pull exerted by their respective springs 52, thereby causing the spindle 50, links 21*a* and head 10 to move downwards, their extreme positions being shown in full line. The springs 52 are too weak for the forward swing of the arms 31 to rock the unit about the axis of spindle 35.

The arms 31 also swing the roller 47 down clear of the strip to the full line position where it is clear of the strip and permits the strip path to be shortened by taking the path shown in full line, namely in which the strip goes directly from the roller 46 to the cross pin 55.

The strip follows the shortened path during the descent of the roller 47 because the descending links 21*a* by the cranked spindle 22, rock the lug 40 which drives the reel 41. The extent of the lug movement is more than sufficient to take up slack in the spent strip between the guide 42 and the reel 41. A clutch in the reel 41 is adjusted so that it slips as soon as the slack in the strip has been taken up.

Printing occurs once the roller 47 is clear of the strip and the strip is stationary.

The arms 31 are still in their foremost positions when the article makes first contact with the applicator arm 13. Further advance of the article rocks the unit about the axis of spindle 35 by means of the arm 13, thus transferring the moment of the unit about the axis from the abutment 20 to the article.

The arms ride over the top of the moving article and eventually descend on their curved portions 53. The printing head 10, clutch lug 40 and roller 47 are returned to their respective positions shown in chain line. As the reel 41 resists being unwound, the roller 47, in rising, contacts the strip and lengthens its path, thereby causing strip to be drawn from the supply reel 15 past the guide 42, and initiating peeling off of a label at the guide. The amount by which the roller 47 lengthens the strip path is less than the pitch length of the labels and therefore detachment of the label at the guide is only partial, complete detachment being effected by adhesion of the label to the article, and the relative movement.

The leading portion of the label which is peeling off the strip at the guide 42 adheres to the article. The label in passing between the article and the rollers 37 is subjected to the full moment of the unit about the axis of spindle 35 to ensure that the label is smoothed down firmly on the article. It will be appreciated that the distance between the centres of the rollers 37 and the guide 42 must be less than the label length in order that the leading part of the label can make tangential contact with the rollers 37 before the trailing portion has been detached from the strip. For example, a suitable distance between centres is 8 mm when the length of the label is 12 mm. Once the article is clear, the unit rocks back to its rest position in which the abutment 20 contacts the cantilever 14.

It will be noted from FIG. 3 that when the arms 31 are in engagment with the top of the article (and correspondinly the roller 47 is at its lowest position) the lowest parts of the arms 31 are higher than the lowest parts of the rollers 37 on the applicator arm 13. When the arm 13 and the unit are being swung upwards, the arms 31 will be raised through a small angle by the spring 52 and the angular movement of the unit. The roller 47, which is on a shorter radius from the pivot spindle 35 than the rollers 37, will be raised correspondingly. Ideally the roller 47 will contact the strip between the roller 46 and cross pin 55, and deflect the strip upwards by a small amount, thereby drawing a corresponding length of strip past the guide 42 and initiating peeling of the label to be applied to the article.

Reference to FIGS. 4A to 4D shows the relative positions of the rollers 46, 47 and pin 55, and the corresponding positions of the label at the guide 42, and of the arms 13, 31 in relation to the article 100. FIG. 4A shows the normal positions of these parts of the unit and the appropriate parts of the strip before the article has contacted the arms 31 and 13. The leading edge of the label is at the guide 42. In FIG. 4B the arms 31 engage the top of the article and have thus swung to their foremost positions. The roller 47 is clear of the strip and is at its lowermost position. The position of the label at the guide 42 is as in FIG. 4A. In FIG. 4C the arms 31 still engage the top of the article but have swung back a little because of engagement of the arm 13 with the article. The engagement has progressed down the arm 13, and the rollers 37 engage the top of the article. The backward swing of the arms 31 has raised roller 47 correspondingly, contacted the strip and drawn the strip past the guide 42 to the extent that the label projects beyond it. In FIG. 4D the arms 31 have slid off the article whereas the rollers 37 still engage the top. The roller 47 has been raised fully and has completed its work in initiating dispensing of the label at the guide 42. The rate at which the initial dispensing is effected depends partly on the curvature at 53 of the arms 31, and the action of the springs 52 in opposition to gravitational pull on the arms 31. The label is now at the rollers 37 in readiness to adhere to the article. The position of the label in FIG. 4D is transient, adhesion to the article and snatching off probably taking place immediately. The strip itself is then advanced by the snatching action. A fresh label is consequently positioned at the guide as in FIG. 4A.

FIG. 5 shows a modification which can be made in the unit shown in FIG. 3. The rollers 45 to 47 are replaced by a cam 56 which rotates with spindle 33, the spindle being rotated by the arms 31. The cam 56 life equivalent to lengthening the strip path by an amount less than the pitch length of the labels.

A freely rotatable roller 57 on a fixed axis above the cam 56 is provided to conduct the strip to the guide 42 without deflection by the cam 56.

The units described with reference to FIGS. 3 and 5 employ no pawl for engagement with the strip between successive labels. It is actually preferred to employ butt labels in such units, i.e. label bearing strip in which successive labels vitually abut edge on edge in contrast to the label strip which is suitable for use in the machines shown in FIGS. 1 and 2, in which successive labels are spaced by a gap (i.e. an intervening length of bare strip) of perhaps 2 mm minimum, there also being longitudinal bare margins of perhaps 4 mm minimum. There are no such gaps and longitudinal margins of bare carrier strip in butt label strip. Thus there can be a substantial (say 25%) saving in paper in the manufacture of the carrier strip for bearing butt labels in contrast to the carrier strip for bearing equivalent labels spaced along it.

In the embodiments above described, the arms 13 and 31 may be operated, for example, by flights spaced along the conveyor or by a convenient linkage thereto instead of by the articles themselves. However, when the machines are required to work to suit a feed rate of the articles which is above the critical rate, the movement of the arms 13, 31 which results in lengthening of the strip path and consequential peeling off of a label, must be allowed to take place under gravity or otherwise at a suitably low acceleration consistent with the articles becoming labelled.

The advance of label strip past the applicator which is initiated by operation of the machine during each cycle and accompanied by peeling of the leading portion of a label, is completed by adhesion of the label to one of the articles being moved past the machine and consequential pulling of the strip past the applicator by the label, the advance of the strip due to the machine and the pulling by the label being equal to the pitch length of the labels.

I claim:

1. A labelling machine for repetitive cycle operation having a strip to which is affixed pressure-sensitive adhesive labels spaced apart at a constant pitch therealong for applying a label to successive articles moving past the machine, comprising:

a mounting;

a supply reel supporting the label strip and a wind up reel for collecting the spent strip, said reels being supported for rotation on parallel axes on said mounting;

drive means for said wind up reel;

a label applicator carried on said mounting and disposed in the path of the moving articles and receiving the label strip from said supply reel, dispensing a label from the strip on to one article of said successive articles in each cycle of the machine, and passing spent strip on to the wind up reel;

first means for causing initial advance of the label strip past said applicator during each cycle of the machine so as to cause said applicator to dispense a leading portion of a label for adhesion to said one article while a residual portion of the label which is complementary to said leading portion is still adhering to the label strip;

second means for limiting operation of said first means and said advance thereby, further advance of the strip, namely to the extent of said residual portion of the label adhering to the strip, being effected by adhesion of said leading portion of the label to said one article and by consequential pulling of the strip past said applicator by said adhesion of said label to the strip until said label is fully detached from the strip;

said label applicator being coupled with said drive means and being motivated by and deriving movement from said one article thereby causing said drive means to drive said wind up reel and bring a label on said strip adjacent to said applicator without advancing said leading portion of the label past said applicator; and, a drawing off arm carried on said mounting motivated by and deriving movement from said one article and causing said first means to cause said initial advance of the label strip and dispensing of said leading portion of the label while the wind up reel is stationary.

2. The labelling machine according to claim 1 wherein said first means comprises an assembly of relatively movable guides disposed on said mounting, relative movement between said guides cyclically lengthening and shortening the path of the strip between the applicator and wind-up reel, so as to draw the strip past the applictor to dispense said leading portion of a label in each cycle of operation of the machine, the cyclic change in the length of the strip path produced by said relative movvement between said guides being equal to said leading portion of the label.

3. The labelling machine according to claim 2, wherein said drawing off arm is disposed in the path of the moving article, and coupled to said guides to cause said relative movement between the guides on the mounting to lengthen and shorten the path of the strip.

4. The labelling machine according to claim 3 wherein said drawing off arm comprises a rockable arm pivotably coupled to said mounting for contact and movement by said one article, and said drawing off arm causes a shortening of the strip path when contacted by said one article.

5. The labelling machine according to claim 4 including a link and weight coupled to said guides and said drawing off arm arranged to move under gravity to lengthen the strip path.

6. The labelling machine according to claim 4 wherein the movable guides comprises an assembly of three rollers each on respective spaced centers, the centers of two of the rollers being mutually fixed and the center of the third roller being movable relative to the centers of te other two rollers, and the centers of the three rollers are disposed as points of a triangle.

7. The labelling machine according to claim 6 wherein said rockable arm includes a link having one end pivoted on said mounting and having its opposite end pivotably supporting the movable center of said third roller, and a weight secured to the arm for returning the arm and the link after movement of the arm by the article.

8. A labelling machine for repetitive cycle operation having a strip to which is affixed pressure-sensitive adhesive labels spaced apart at a constant pitch therealong for applying a label to successive articles moving past the machine, comprising:

a mounting a supply reel supporting the label strip and a wind up reel for collecting the spent strip, said reels being supported for rotation on parallel axes on said mounting;

drive means for said wind up reel;

a label applicator carried on said mounting and disposed in the path of the moving articles and receiving the label strip from said supply reel, dispensing a label from the strip on to one article of said successive articles in each cycle of the machine, and passing spent strip on to the wind up reel;

first means for causing initial advance of the label strip past said applicator during each cycle of the machine so as to cause said applicator to dispense a leading portion of a label for adhesion to said one article while a residual portion of the label which is complementary to said leading portion is still adhering to the label strip;

second means for limiting operation of said first means and said advance thereby, further advance of the strip, namely to the extent of said residual portion of the label adhering to the strip, being effected by adhesion of said leading portion of the label to said one article and by consequential pulling of the strip past said applicator by said adhesion of said label to the strip until said label is fully detached from the strip; and, a drawing off arm carried on said mounting for operating said drive means and said first means during each cycle of the machine, said drawing off arm being motivated by and deriving movement from said one article, thereby causing said drive means to drive said wind up reel and bring a label on said strip adjacent to said applicator without advancing said leading portion of the label past said applicator, and thereafter causing said first means to cause said initial advance of the label strip and dispensing of said leading portion of the label while the wind up reel is stationary.

9. The labelling machine according to claim 8 wherein said first means comprises a first guide;

a movable second guide; and means for moving said second guide for causing the path of the strip between the first guide and the windup reel for spent strip to be cyclically lengthened and shortened, so as to draw strip past the applicator to dispense said leading portion of a label in each cycle of operation of said first means, the cyclic change in the length of the strip path produced by said relative movement between said guides being equal to said leading portion of the label.

10. The labelling machine according to claim 9 wherein the first guide is carried by the applicator.

11. The labelling machine according to claim 9 wherein said means for moving the second guide are drivingly connected to the wind-up reel.

12. The labelling machine according to claim 9 comprising a printing head disposed on said mounting, and wherein said means for moving the second guide is also drivingly connected to said printing head which is guided for movement in the machine for contact with the labels.

13. The labelling machine according to claim 9, wherein said drawing off arm is disposed in the path of the moving article, and coupled to said movable second guide to cause said relative movement between said guides on the mounting to lengthen and shorten the path of the strip.

14. The labelling machine according to claim 13 wherein said drawing off arm is arranged to be contacted and moved by said one article to cause lengthening of the strip path, and to move under gravity to cause shortening of the strip path.

* * * * *